US012005296B2

(12) United States Patent
Okubadejo

(10) Patent No.: US 12,005,296 B2
(45) Date of Patent: Jun. 11, 2024

(54) DYNAMIC PLANK APPARATUS AND METHOD

(71) Applicant: Gbolahan Okubadejo, Edgewater, NJ (US)

(72) Inventor: Gbolahan Okubadejo, Edgewater, NJ (US)

( * ) Notice: Subject to any disclaimer, the term of this patent is extended or adjusted under 35 U.S.C. 154(b) by 192 days.

(21) Appl. No.: 17/734,767

(22) Filed: May 2, 2022

(65) Prior Publication Data

US 2023/0347202 A1 Nov. 2, 2023

(51) Int. Cl.
*A63B 21/00* (2006.01)
*A63B 21/002* (2006.01)

(52) U.S. Cl.
CPC ..... *A63B 21/4011* (2015.10); *A63B 21/002* (2013.01); *A63B 2208/0285* (2013.01)

(58) Field of Classification Search
CPC ..... A63B 21/002; A63B 21/0023; A63B 2208/0285; A63B 2208/029; A63B 7/00
See application file for complete search history.

(56) References Cited

U.S. PATENT DOCUMENTS 3,984,101 A * 10/1976 Garza ..... A61H 1/0218 482/142
5,399,139 A * 3/1995 Malynowsky ..... A63B 21/4015 248/188.7
9,439,824 B1 * 9/2016 Shimmel, Sr. ..... A61H 11/00
10,695,601 B2 * 6/2020 Souffrain ..... A63B 1/00
2012/0035031 A1 * 2/2012 Silverman ..... A63B 21/1645 482/139
2012/0122638 A1 * 5/2012 Cares ..... A63B 21/0023 482/145
2012/0329620 A1 * 12/2012 White ..... A63B 23/1236 482/131
2015/0133277 A1 * 5/2015 Alexandrov ..... A63B 21/4035 482/131
2017/0014666 A1 * 1/2017 Sather ..... A63B 21/4045

OTHER PUBLICATIONS

Mind Pump, Plank Variations for Your Core Using a Suspension Trainer [online], Published: Jun. 25, 2021, <URL: https://www.youtube.com/watch?v=_gKo9FlktyE > (Year: 2021).*
Creepster Crawler Review, Timmermans [online], Published Aug. 10, 2021, <URL: https://www.youtube.com/watch?v=FiMZwp9T79U > (Year: 2021).*

* cited by examiner

*Primary Examiner* — Zachary T Moore
(74) *Attorney, Agent, or Firm* — Lawrence B. Goodwin; Mandelbaum Barrett PC

(57) ABSTRACT

Apparatus and method for facilitating a dynamic plank exercise comprises a generally horizontally disposed structure, a plurality of legs supporting, at their upper ends, the structure, rollers disposed on lower ends of the plurality of legs and adapted to rest upon a floor surface, the rollers allowing the legs, and the structure, to be translated relative to the floor surface, and a pair straps vertically suspended from the structure, the straps adapted to support the users' legs, whereby, the users may place their legs in the straps and perform exercises with the users' arms supported by the floor surface, wherein the users are able to translate their legs relative to their arms as the structure is translated on the floor surface.

10 Claims, 5 Drawing Sheets

DYNAMIC PLANK APPARATUS AND METHOD

FIELD OF THE INVENTION

The present invention is directed to core strengthening exercise equipment and routines, and in particular, an apparatus and method that greatly improve the benefits of an exercise commonly referred to as a plank.

BACKGROUND

Core strengthening exercises have become widely accepted as an important exercise regimen. Such exercises strengthen core muscles, including abdominal muscles, back muscles and the muscles around the pelvis. The core muscles keep people upright, balanced, and mobile. Strong core muscles lead to better balance and stability, making it easier to do many physical activities. Thus, strong core muscles are important to achieve and maintain.

A particularly good core exercise is commonly referred to as a "plank." A plank is a simple, but effective bodyweight core exercise that help build stability and strength throughout the entire body, but in particular, it can strengthen the spine, rhomboids and trapezius, and abdominal muscles, which can result in better posture and bone alignment.

Although planks are effective promoting skeletal and muscle health, they typically are static, i.e., the user typically does not move during the plank, or if they do, it is a very limited movement, for example the lifting of a leg momentarily. Thus, although the benefits of planks are significant, the generally static nature of the exercise naturally limits its potential benefits.

SUMMARY OF THE INVENTION

Thus, the present invention is directed to equipment, and a method, specifically designed to facilitate dynamic plank exercises that can greatly enhance the quality and benefits of ordinary planks.

In accordance with a first aspect of the invention, apparatus for facilitating a dynamic plank exercise comprises a generally horizontally disposed structure, a plurality of legs supporting, at their upper ends, the structure, rollers disposed on lower ends of the plurality of legs and adapted to rest upon a floor surface, the rollers allowing the legs, and the structure, to be translated relative to the floor surface, and a pair straps vertically suspended from the structure, the straps adapted to support the users' legs, whereby, the users may place their legs in the straps and perform exercises with the users' arms supported by the floor surface, wherein the users are able to translate their legs relative to their arms as the structure is translated on the floor surface. The rollers provide substantially 360 degrees of movement, such that the users can draw their knees forward and backward to perform a back-and-forth motion while their legs are in the straps and their arms are supported by the floor surface, and can rotate their legs relative to their arms to perform a side-to-side motion while their legs are in the straps and their arms are supported by the floor surface.

The structure may be a horizontally disposed platform, and four legs may support the structure. A strap support may also be provided, wherein the straps are supported by the structure by the strap support which, in turn, is adjustably supported by the structure, such that the vertical position of the straps relative to the floor surface can be adjusted. The apparatus can further comprise a vertical shaft attached to and extending below the structure, and wherein the strap support is adjustably supported on the vertical shaft. The vertical shaft can be provided with a plurality of holes or detents, and the strap support is provided with a pin adapted to be positioned in one of the plurality of holes or detents in the vertical shaft to provide vertical adjustment of the straps relative to the floor surface. Additionally, the vertical position of the vertical shaft can be adjusted relative to the structure.

A method for facilitating a plank exercise in accordance with a second aspect of the invention comprises providing a pair of straps supported above, but moveable relative to, a floor surface, supporting a user's legs in a pair of straps, supporting the user's arms on the floor surface to thereby facilitate a plank position, and moving the user's legs from side-to-side and back and forth relative to the user's arms, to thereby facilitate a dynamic plank. The method may further comprise adjusting the vertical position of the pair of straps.

These and other objects and aspects of the present invention will be described in more detail with reference to the following drawings.

DETAILED DESCRIPTION

With reference to the figures, the dynamic plank apparatus 10 of the present invention includes four legs 12*a*-12*d* upon which is mounted a structure, for example, a rectangular platform 14, the upper ends of the legs positioned at the corners of the platform. The lower ends of each of the legs are provided with rollers 16*a*-16*d* providing substantially 360 degrees of movement such that the apparatus 10 is freely moveable in any direction. Although axially mounted, rotatable wheels are shown in the figures, ball and socket or other types of rollers may be used, as long as they provide the necessary degrees of freedom of movement, as described below. The lower portions of legs 12*a*-12*d* preferably are interconnected, as shown, by a stabilizing frame 18 to stabilize the apparatus and avoid undue flexure thereof.

Figure 1:
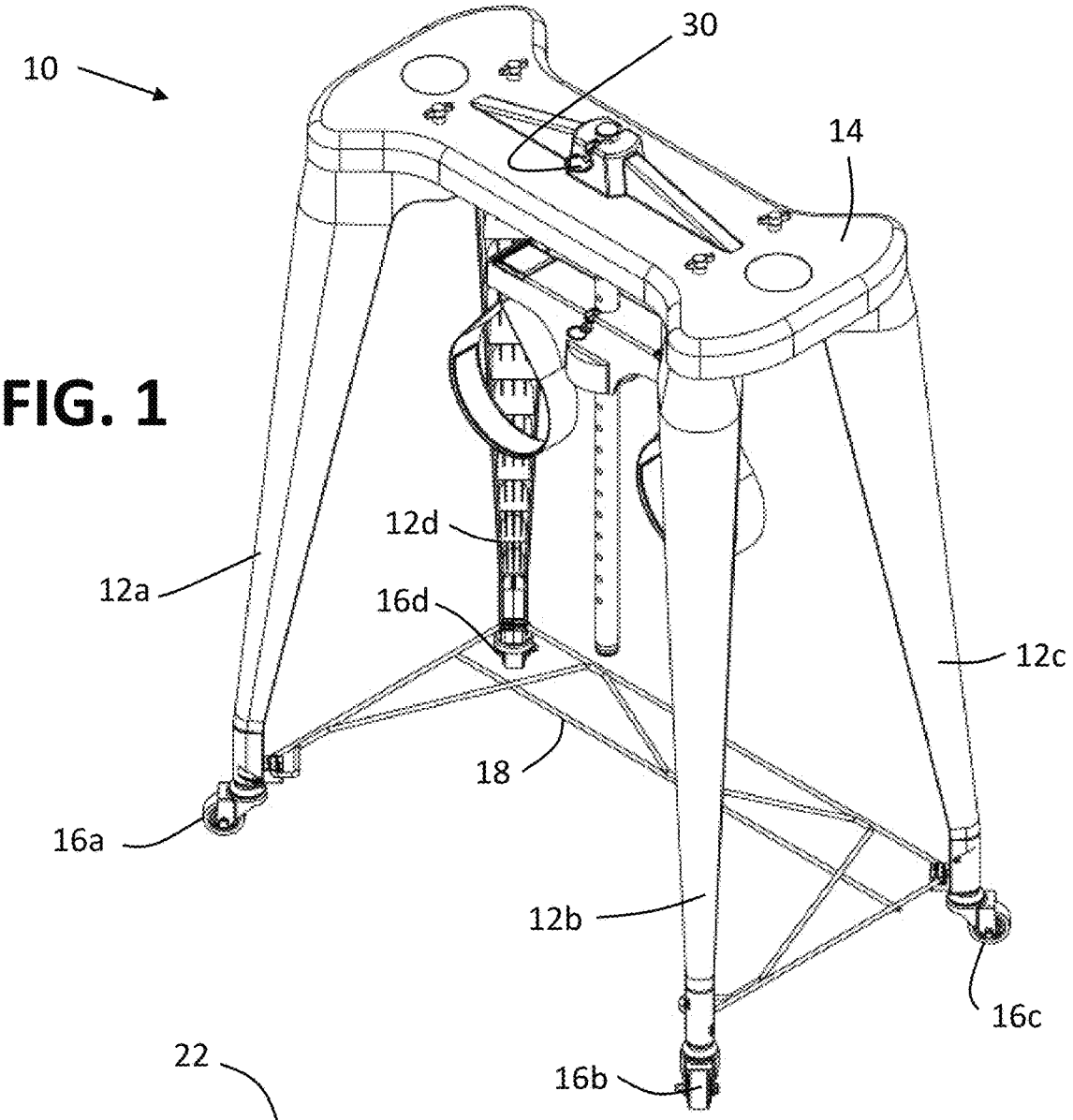
FIG. 1 is a perspective view of the dynamic plank apparatus in accordance with the present invention.
Figure 3:
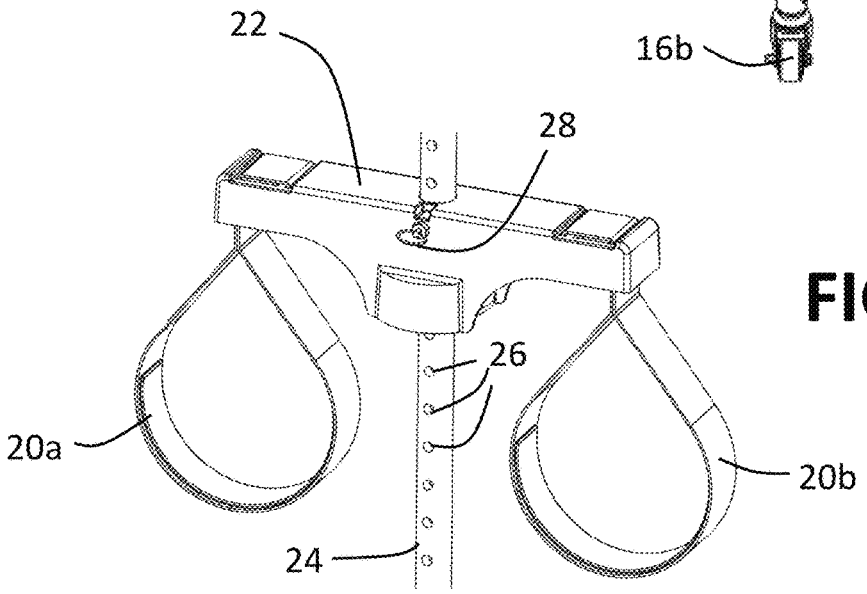
FIG. 3 is a perspective view of the straps used with the dynamic plank apparatus of FIG. 1.
Figure 2:
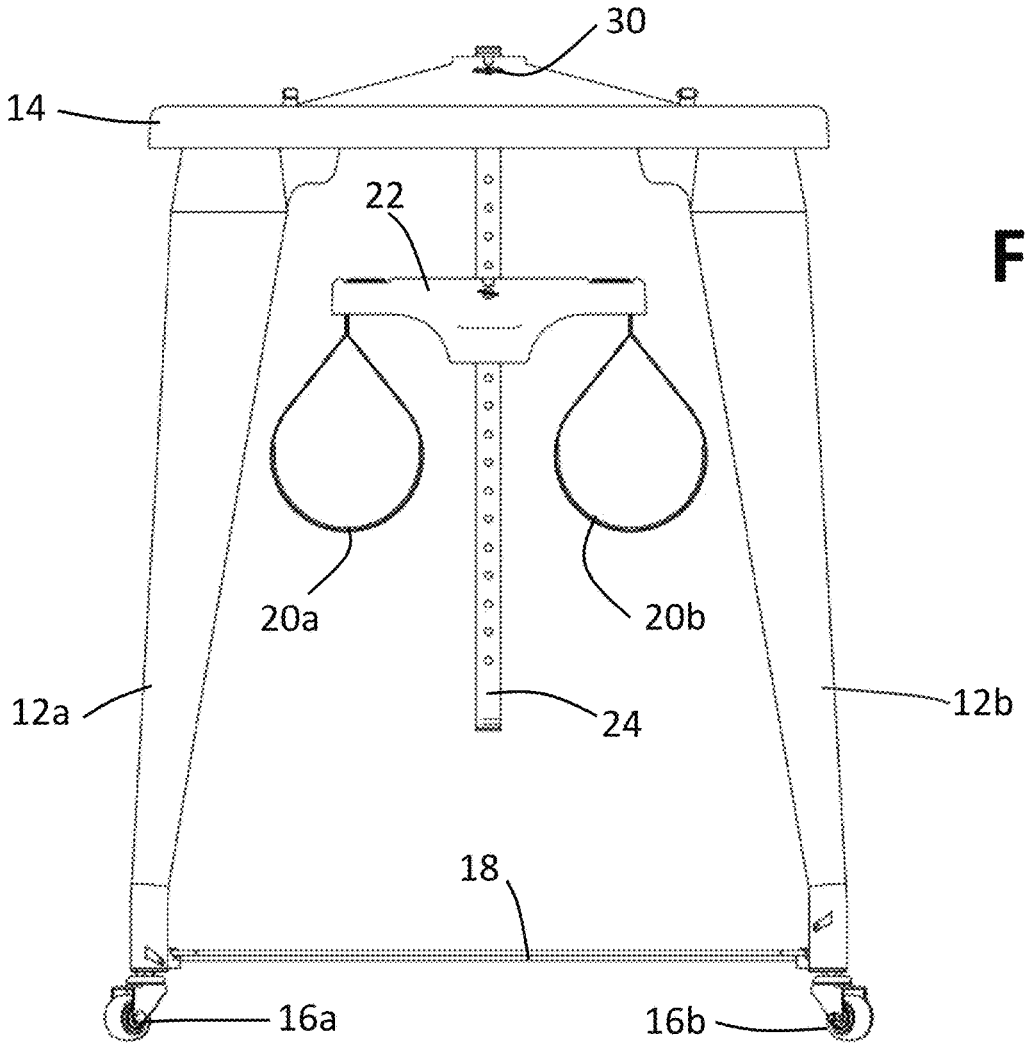
FIG. 2 is a front view of the dynamic plank apparatus of FIG. 1.
Figure 4:
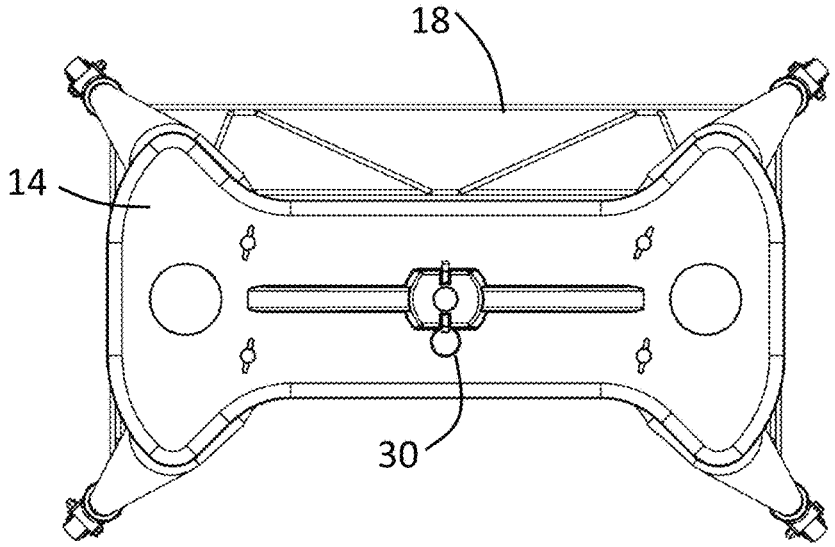
FIG. 4 is a top view of the dynamic plank apparatus of FIG. 1.

As best shown in FIGS. 2 and 3, straps 20*a*, 20*b* are vertically suspended from a generally horizontal strap support 22, which in turn is adjustably mounted on vertical shaft 24, the latter of which is provided with a plurality of holes or detents 26 into which pin 28, mounted on the support 22, is inserted. Thus, the vertical position of the strap support 22 on shaft 24 can be adjusted by selection of the hole or detent 26 into which the pin 28 is inserted. The pin 28 can be spring-mounted on the support 22 to facilitate easy vertical adjustment of the support 22 on the shaft 24.

Figure 5:
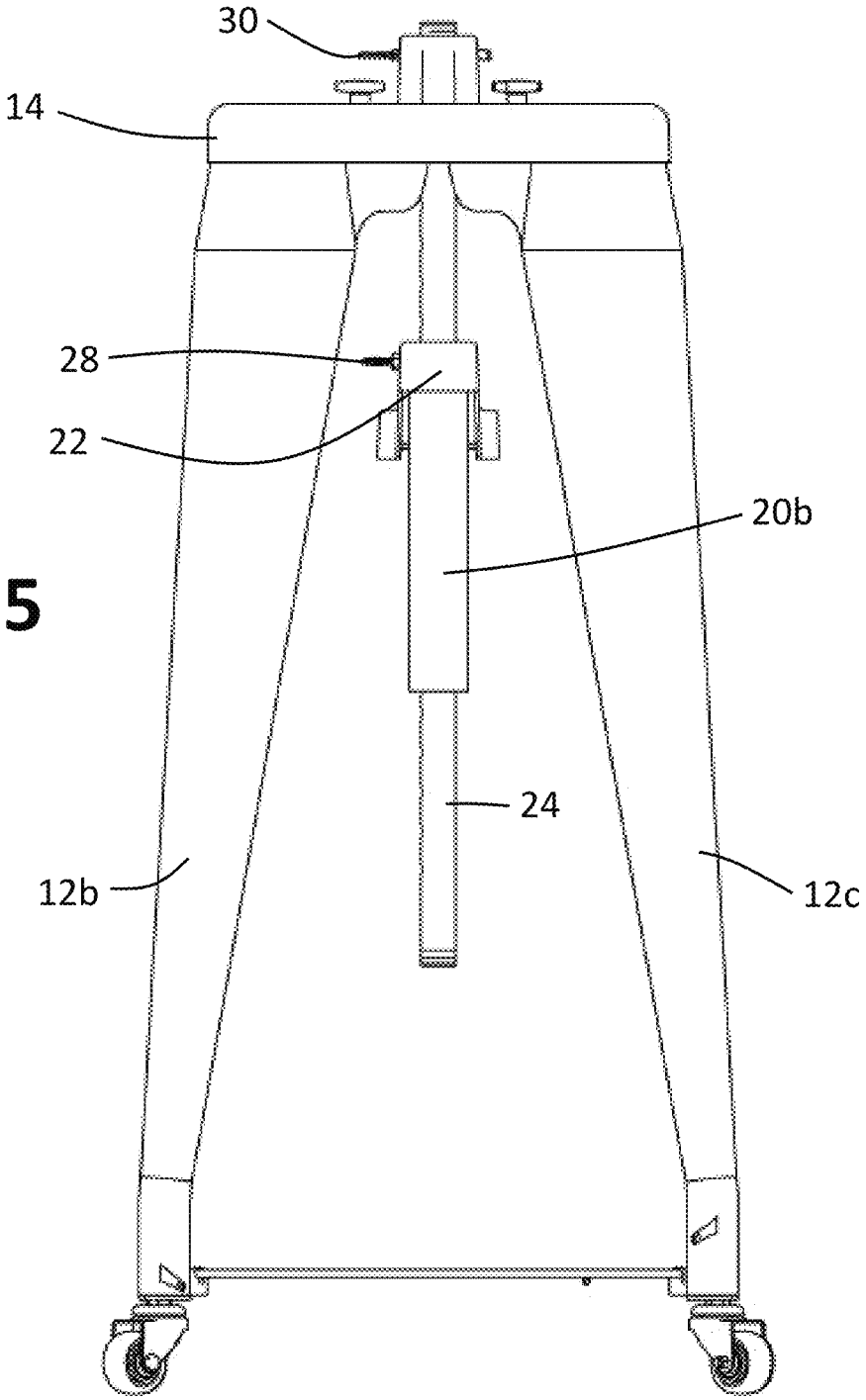
FIG. 5 is a side view of the dynamic plank apparatus of FIG. 1.
Figure 6A:
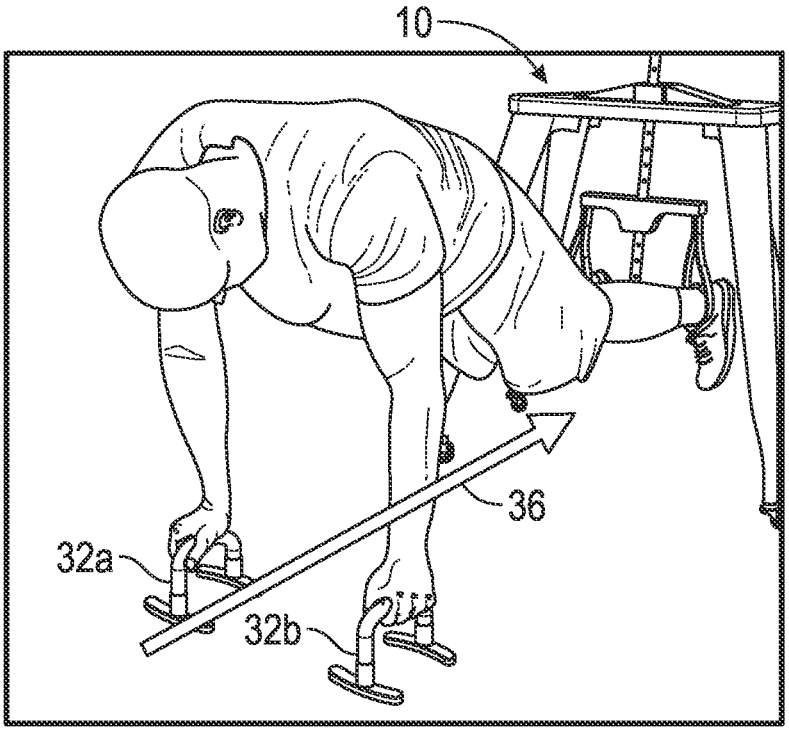
FIGS. 6A and 6B are illustrations of an example of a front-to-back dynamic routine using the dynamic plank apparatus of the present invention.
Figure 6B:
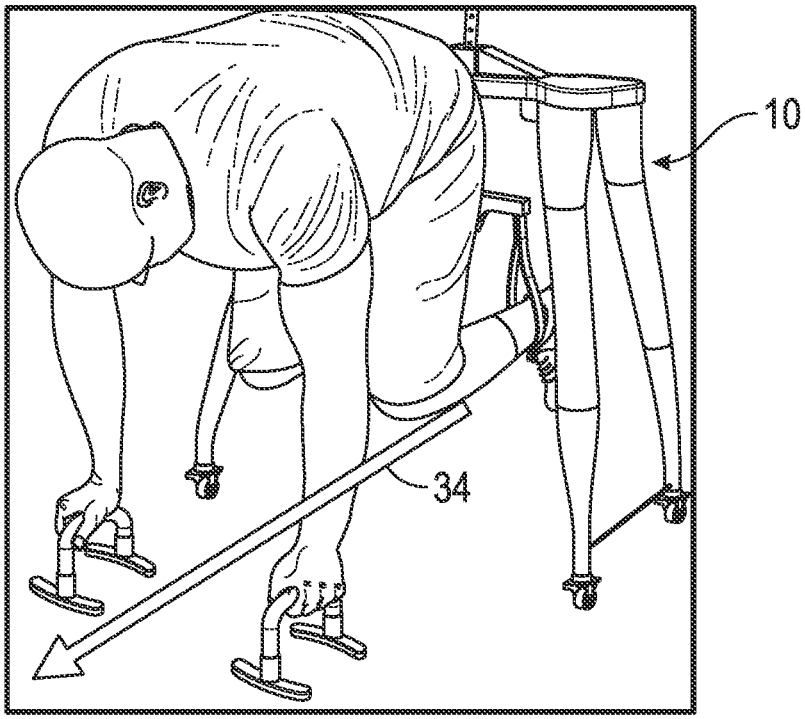

As best shown in FIGS. 2 and 5, the shaft 24 extends vertically upward through an aperture generally centrally located in the platform 14, and is held in place by a pin 30, or similar expedient, connected to the platform 14. Thus, the vertical height of the strap support 22, and the straps 20*a*, 20*b*, relative to the surface upon which the apparatus sits, is substantially adjustable. Moreover, the entire apparatus, including the straps, is moveable by virtue of the wheels 16*a*-16*d*.

Figure 7A:
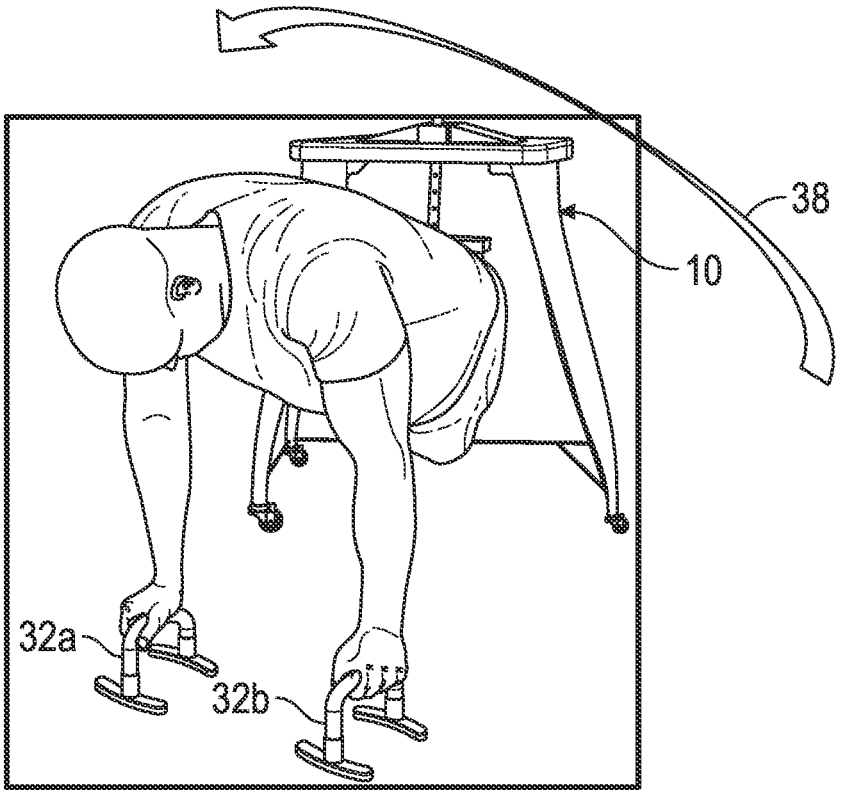
FIGS. 7A and 7B are illustrations of an example of a side-to-side dynamic routine using the dynamic plank apparatus of the present invention.
Figure 7B:
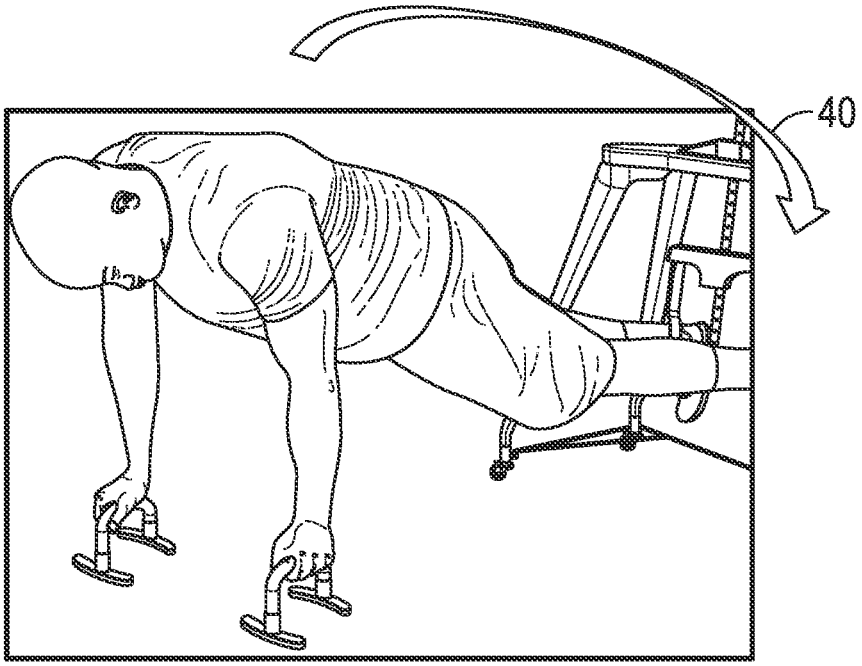

The dynamic plank method enabled through the use of the dynamic plank apparatus will be described with reference to FIGS. 6A, 6B, 7A and 7B. As shown, users can place their feet through straps 20*a*, 20*b*, such that they support the users' legs between the users' feet and knees, preferably proximate to the ankle. The height of the straps is adjusted for the particular user by adjusting the location of the strap support on the vertical shaft, as described above. The users can then assume a position similar to that shown in FIG. 6A, by using optional hand supports 32*a*, 32*b*. Alternatively, users can place their hands directly on the floor, keeping their arms straight, or they can place their entire forearms on the floor in standard plank position. Then, the users can pull their legs forward, in the direction shown by arrow 34, FIG. 6B, and then push their legs straight back, in the direction of arrow 36, FIG. 6A. Alternatively, as illustrated in FIGS. 7A and 7B, instead of straight back and forth motion, the users can keep their legs straight but rotate at their hips and upper body left and right in the directions of arrows 38 and 40.

The flexibility to dynamically move their legs in this manner adds a new dimension to users' exercise routine, by enhancing the quality and benefits of ordinary planks.

It will be understood that various changes in the details and arrangements of the apparatus and method which have been herein described and illustrated in order to explain the nature of the invention may be made by those skilled in the art within the principle and scope of the invention as expressed in the following claims.

What I claim is:

1. An apparatus for facilitating a dynamic plank exercise, comprising:

a. a generally horizontally disposed structure;

b. a plurality of legs supporting, at their upper ends, said structure;

c. rollers disposed on lower ends of said plurality of legs and adapted to rest upon a floor surface, said rollers allowing said legs, and said structure, to be translated relative to said floor surface;

d. a pair straps vertically suspended from said structure, said straps adapted to support users' legs; and e. a strap support, wherein said straps are supported by said structure by said strap support which, in turn, is adjustably supported by said structure, such that a vertical position of said straps relative to said floor surface can be adjusted;

f. whereby, said users are able to place their legs in said straps and perform exercises with said users' arms supported by said floor surface, wherein said users are able to translate their legs relative to their arms as said structure is translated on said floor surface.

2. The apparatus of claim 1 wherein said rollers provide substantially 360 degrees of movement.

3. The apparatus of claim 2 wherein said users are able to draw their knees forward and backward to perform a back-and-forth motion while their legs are in said straps and their arms are supported by said floor surface.

4. The apparatus of claim 3 wherein said users are able to rotate their legs relative to their arms to perform a side-to-side motion while their legs are in said straps and their arms are supported by said floor surface.

5. The apparatus of claim 1 wherein said structure is a horizontally disposed platform.

6. The apparatus of claim 1 wherein four legs support said structure.

7. The apparatus of claim 1, further comprising a vertical shaft attached to and extending below said structure, and wherein said strap support is adjustably supported on said vertical shaft.

8. The apparatus of claim 7 wherein said vertical shaft is provided with a plurality of holes or detents.

9. The apparatus of claim 8 wherein said strap support is provided with a pin adapted to be positioned in one of said plurality of holes or detents in said vertical shaft to provide vertical adjustment of said straps relative to said floor surface.

10. The apparatus of claim 9, wherein the vertical position of said vertical shaft can be adjusted relative to said structure.

* * * * *